United States Patent [19]

Cherryholmes

[11] Patent Number: 4,624,241

[45] Date of Patent: Nov. 25, 1986

[54] REFLECTOR FOR RADIANT HEATER

[75] Inventor: John T. Cherryholmes, Potwin, Kans.

[73] Assignee: The Coleman Company, Inc., Wichita, Kans.

[21] Appl. No.: 763,207

[22] Filed: Aug. 7, 1985

Related U.S. Application Data

[63] Continuation-in-part of Ser. No. 576,035, Feb. 1, 1984, Pat. No. 4,569,329.

[51] Int. Cl.[4] ..... F24C 3/04

[52] U.S. Cl. ..... 126/92 B; 431/329

[58] Field of Search ..... 126/92 B, 92 R, 92 A, 126/93, 96, 95; 431/328, 329, 326, 327; 362/277–279, 287, 418; 34/4

[56] References Cited

U.S. PATENT DOCUMENTS

| | | | |
|---|---|---|---|
| 3,538,324 | 11/1970 | Hankins | 362/277 |
| 4,141,060 | 2/1979 | Lackore | 34/4 |

FOREIGN PATENT DOCUMENTS

| | | | |
|---|---|---|---|
| 599295 | 1/1926 | France | 126/92 B |
| 790581 | 11/1935 | France | 362/277 |
| 403490 | 12/1933 | United Kingdom | 126/92 B |

*Primary Examiner*—James C. Yeung

[57] ABSTRACT

A radiant heater includes a tilting and focusing reflector and a burner which is mounted inside of the reflector. The reflector can be tilted to direct radiant energy from the burner in a desired direction, and the focal point of the reflector can be moved with respect to the burner to concentrate, direct, or disperse radiant energy.

3 Claims, 21 Drawing Figures

FIG. 9
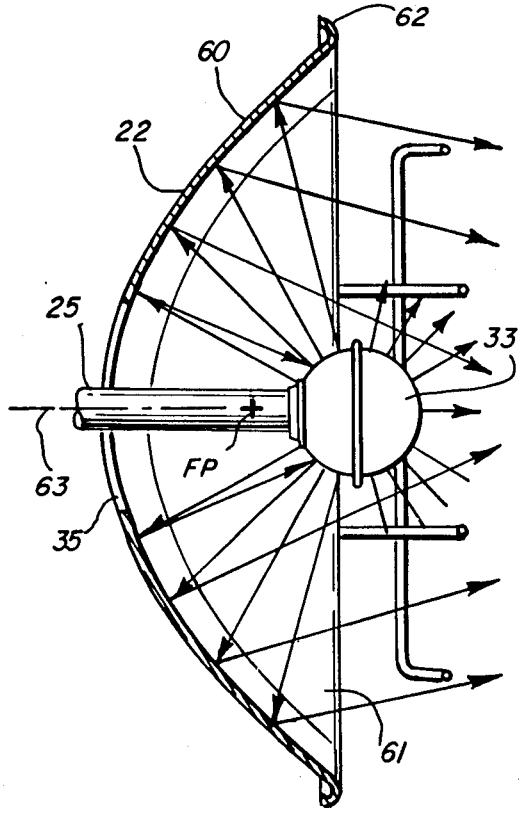
FIG. 10
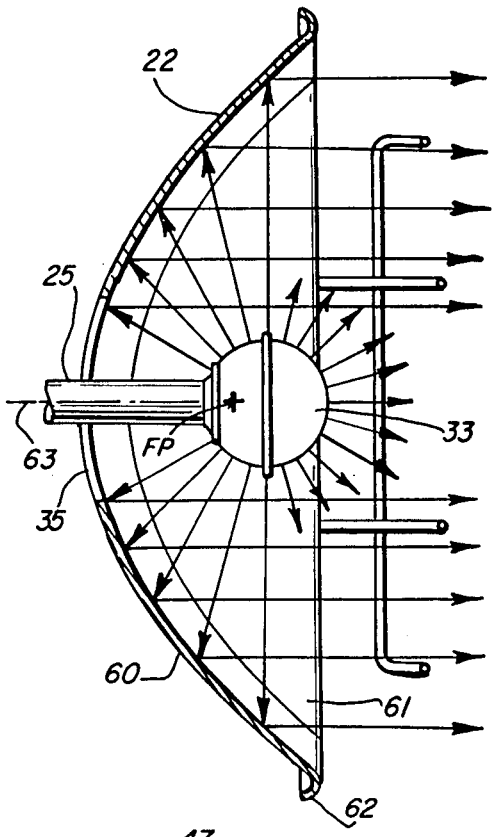
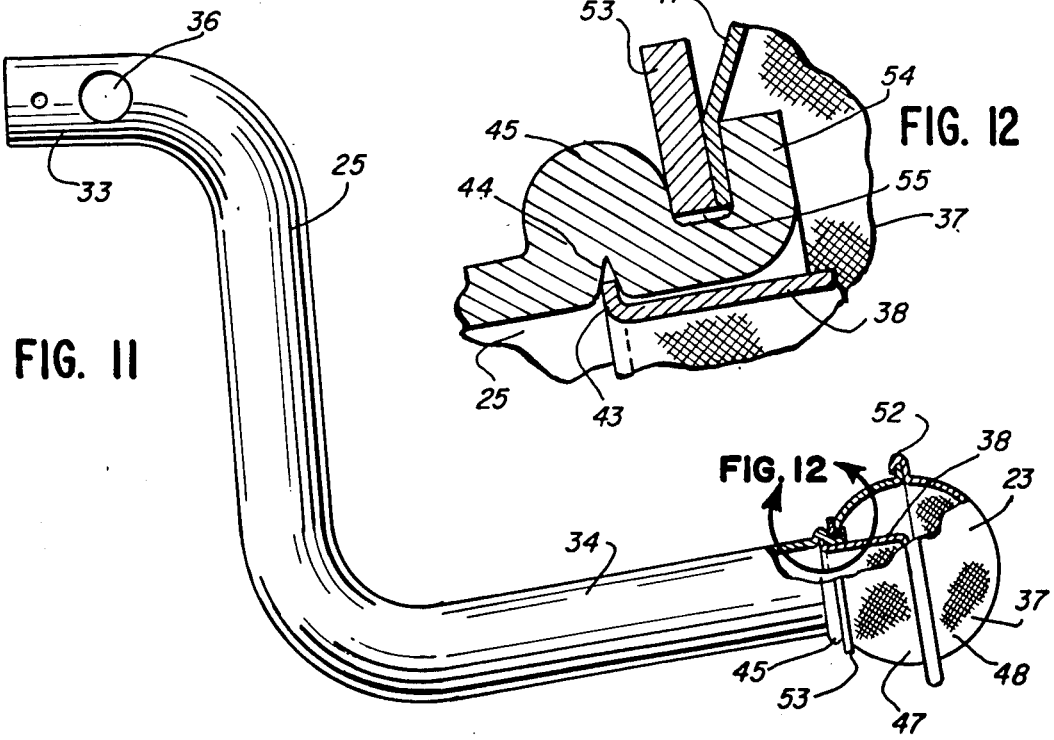
FIG. 11
FIG. 12

REFLECTOR FOR RADIANT HEATER

RELATED APPLICATION

This application is a continuation-in-part of my copending application Ser. No. 576,035, filed Feb. 1, 1984, U.S. Pat. No. 4,569,329.

BACKGROUND AND SUMMARY

This invention relates to radiant heaters, and, more particularly, to a radiant heater which is provided with a tilting and focusing reflector.

Radiant heaters generally include a fuel source, such as propane or gasoline, a burner for burning the fuel in creating radiant heat energy, and a reflector for directing the radiant energy from the burner to the area which is to be heated. It is desirable that the reflector be movably mounted on the burner so that the radiant energy of the heater can be directed, dispersed, or concentrated.

In accordance with the invention the reflector is mounted for sliding movement toward and away from the burner so that focal point of the reflector can be positioned as desired. When the focal point is at the burner, radiant energy is focused and directed straight ahead in a concentrated beam. When the focal point is behind the burner, radiant energy is dispersed. The reflector is also mounted for tilting movement so that the direction in which the radiant energy is directed can be varied.

DESCRIPTION OF THE DRAWING

The invention will be explained in conjunction with an illustrative embodiment shown in the accompanying drawings, in which—

FIG. 9 is a sectional view through the reflector showing the reflecting of radiant energy when the focal point of the reflector is behind the burner;

FIG. 10 is a sectional view through the reflector showing the reflecting of radiant energy when the focal point of the reflector is at the burner;

FIG. 11 is a side elevational view of the burner assembly;

FIG. 12 is an enlarged fragmentary sectional view of a portion of FIG. 11;

DESCRIPTION OF SPECIFIC EMBODIMENT

Figure 1:
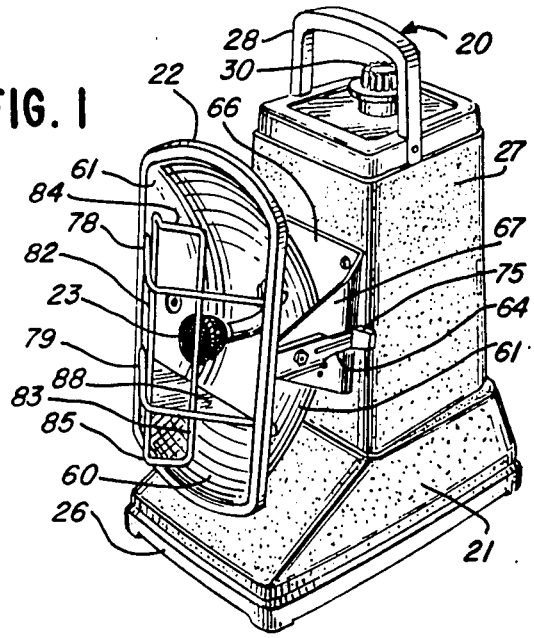
FIG. 1 is a perspective view of a radiant heater formed in accordance with the invention.
Figure 2:
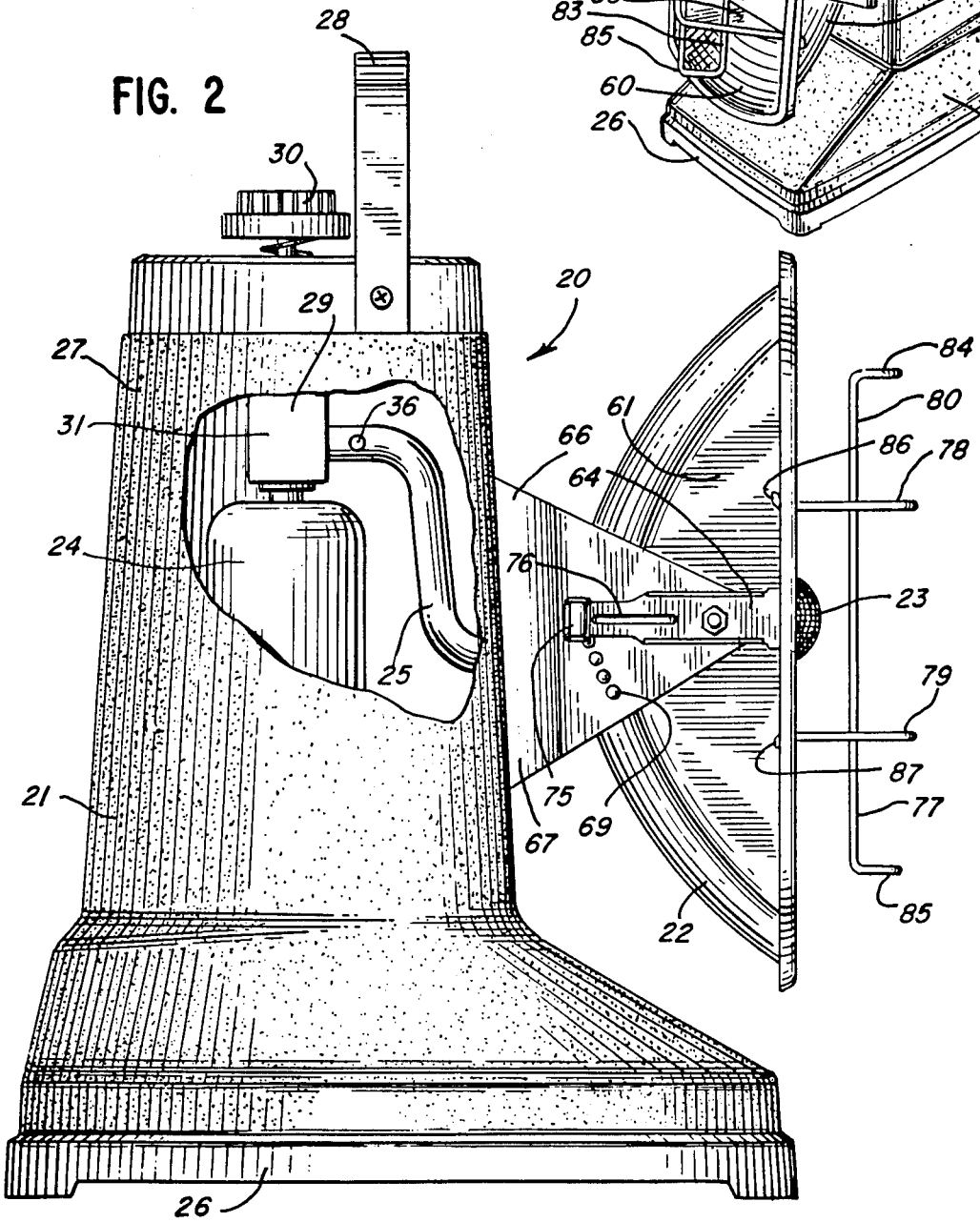
FIG. 2 is a side elevational view, partially broken away, of the heater of FIG. 1.
Figure 3:
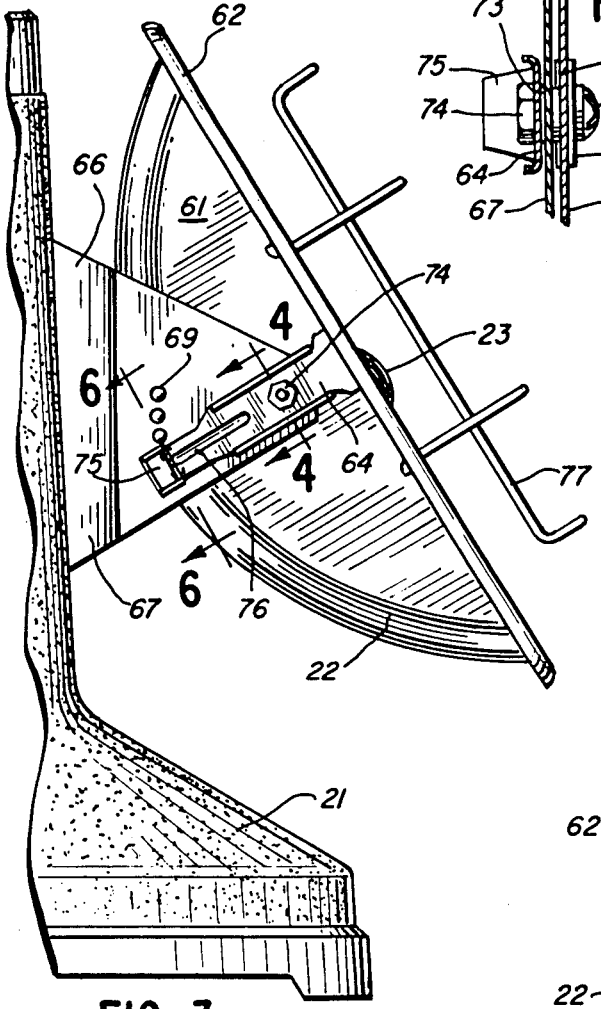
FIG. 3 is a fragmentary side elevational view showing the reflector tilted upwardly.

Referring first to FIGS. 1 and 2, a radiant heater 20 includes a base 21, a reflector 22, and a burner 23 mounted within the reflector. The particular heater illustrated is a propane burner, and a conventional propane tank 24 supplies fuel to the burner through a burner tube 25 (see also FIG. 11).

The base 21 includes an enlarged, generally rectangular bottom portion 26 and a vertically extending upper portion 27. A handle 28 is attached to the top of the base. The base is hollow and provides a chamber for the propane tank. A propane regulator 29 is mounted on the top wall of the base, and flow through the regulator is controlled by a control knob 30 on the top of the base. The regulator includes a conventional internally threaded connector portion 31 into which the threaded connection of the propane tank is screwed.

Burner Assembly

Figure 7:
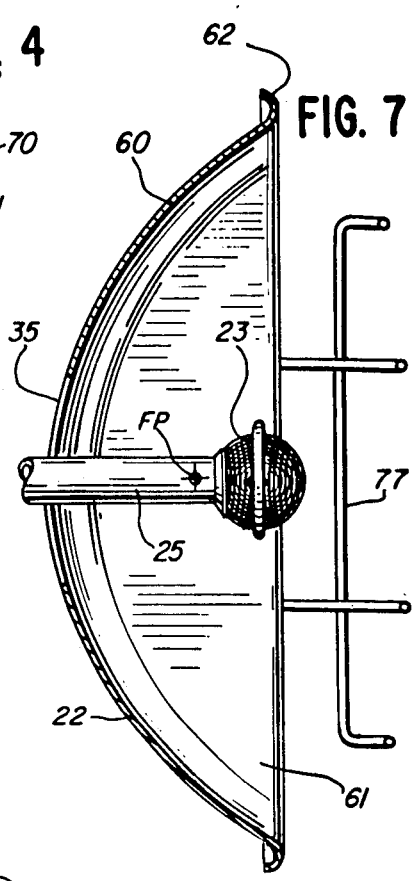
FIG. 7 is a sectional view through the reflector when the reflector is in its untilted position shown in FIG. 2.
Figure 8:
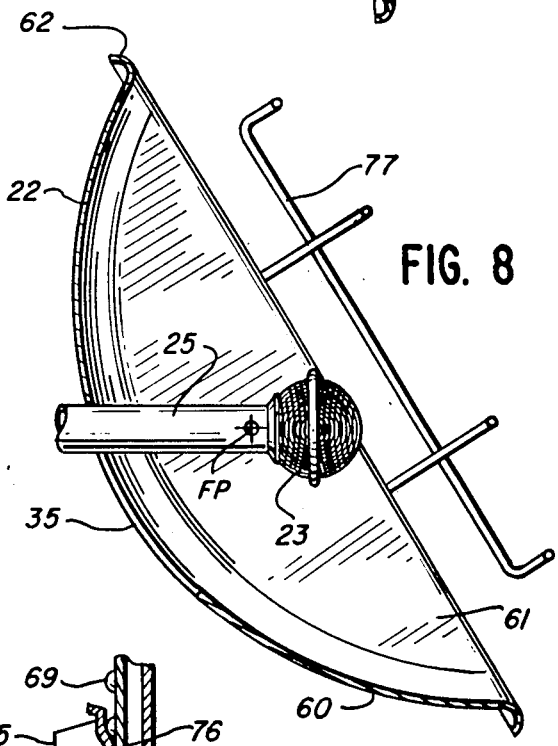
FIG. 8 is a sectional view through the reflector when the reflector is in the tilted position of FIG. 3.

Referring to FIG. 11, the burner tube 25 is generally Z-shaped and includes a first end portion 33 which is connected to the regulator 29 and a second end portion 34 which extends through a vertically elongated opening 35 in the reflector 22 (FIGS. 7 and 8). The burner tube is made of metal, and the rigidity of the tube maintains the position of the burner 23 even though the reflector is movable as will be described hereinafter. Combustion air opening 36 is provided in the burner tube adjacent the regulator 29, and combustion air is aspirated through the air opening by fuel flowing through the tube so that an air/fuel mixture is delivered to the burner.

Figure 13:
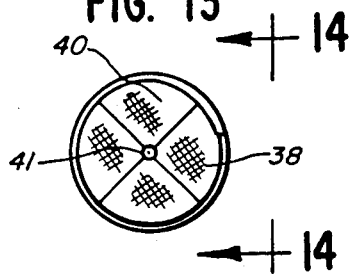
FIG. 13 is an end view of the port screen of the burner assembly.
Figure 14:
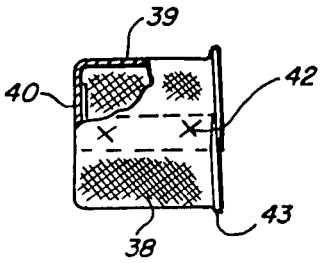
FIG. 14 is a side elevational view, partially broken away, of the port screen of FIG. 13.
Figure 15:
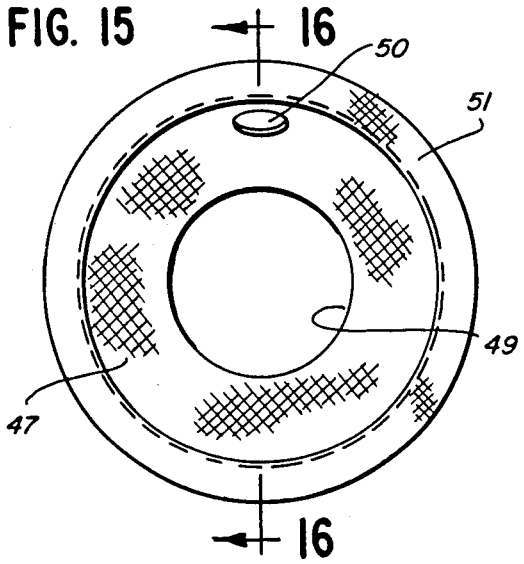
FIG. 15 is a top plan view of the inner hemisphere of the burner.
Figure 16:
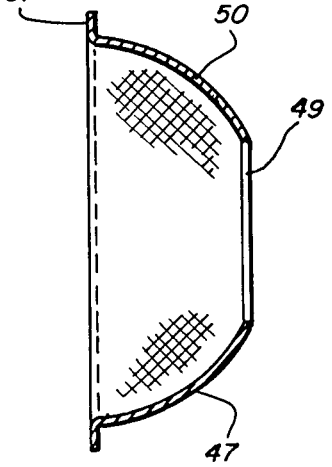
FIG. 16 is a sectional view taken along the line 16—16 of FIG. 15.
Figure 17:
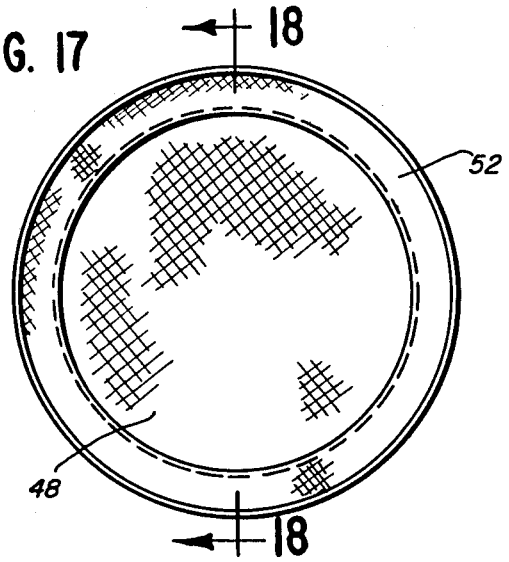
FIG. 17 is a bottom plan view of the outer hemisphere of the burner.
Figure 18:
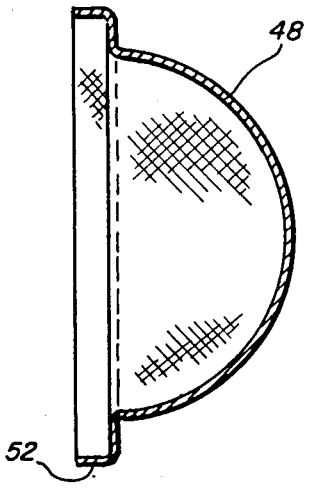
FIG. 18 is a sectional view taken along the line 18—18 of FIG. 17.
Figure 20:
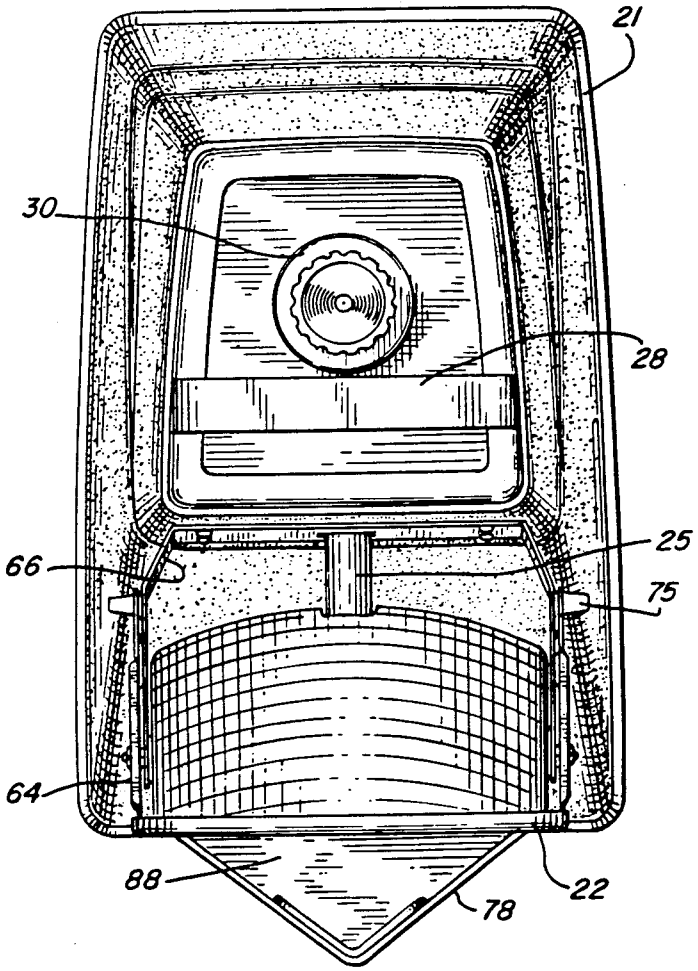
FIG. 20 is a top plan view of the heater.
Figure 19:
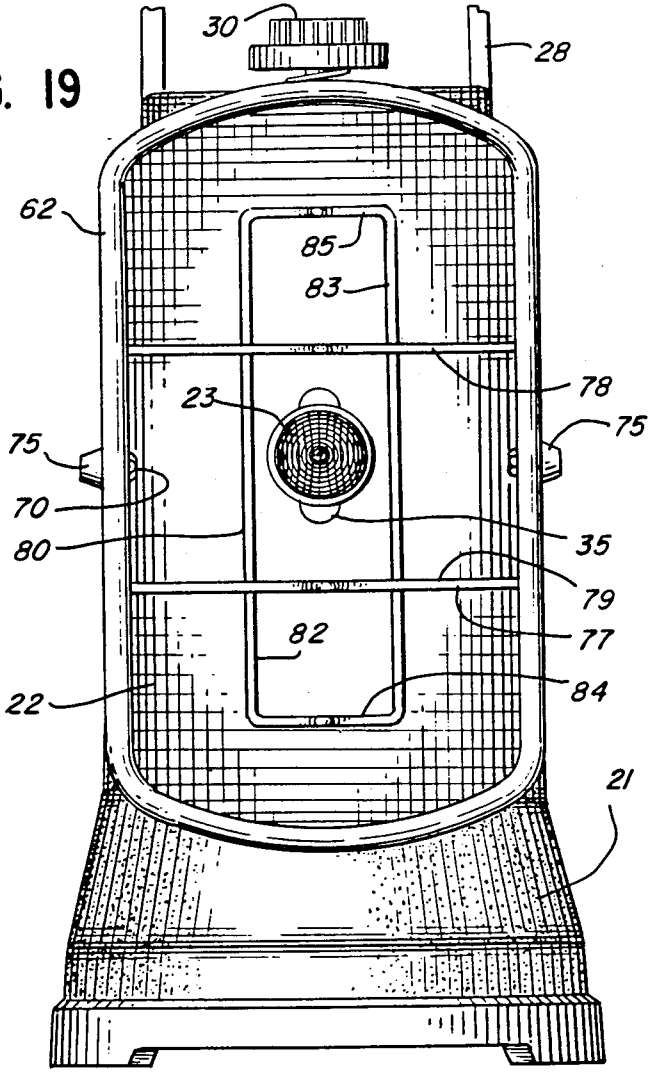
FIG. 19 is a front elevational view of the heater.

The burner head 23 includes a generally spherical burner screen 37 which is mounted on the outside of the burner tube and a generally cylindrical port screen 38 which is mounted on the inside of the burner tube. Referring to FIGS. 12–14, the port screen 38 is formed from a screen or wire cloth which is wrapped in a cylindrical shape to form a cylindrical side wall 39, and one end of the screen is folded to provide a closed end 40. A spotweld 41 on the end and two spotwelds 42 on the side secure the screen. The other end of the port screen is flared outwardly to provide an attaching flange 43.

As soon in FIG. 12, the attaching flange 43 of the port screen 38 is inserted into an annular recess 44 in the burner tube which is provided by an annular embossment or rib 45 in the tube.

Referring to FIGS. 15–18, the spherical burner screen 37 is formed from two generally hemispherically shaped screens or wire cloths 47 and 48. The inner hemisphere 47 is provided with an opening 49 through which the burner tube extends, a light opening 50, and a radially outwardly extending flange 51. The outer hemisphere 48 is intially formed with flange 52 which is L-shaped in cross section. The two hemispheres are joined by crimping the L-shaped flange 52 over the radial flange 51.

The spherical burner screen 37 is mounted on the burner tube 25 by inserting the burner tube through the opening 49 in the inner hemispherical screen 47 before the inner and outer hemispherical screens are crimped together. A washer 53 (FIG. 12) is inserted between the rib 45 and the inner screen 47, and the end of the burner tube is then flared outwardly to provide a flange 54 which secures the inner screen against the washer 53. The flange 54 and the rib 45 define an annular recess 55 in the outside of the burner tube.

The burner is ignited by opening the regulator valve and inserting a match near the light opening 50 in the inner hemisphere of the burner. After the air/fuel mixture is ignited, the flame burns substantially entirely within the spherical burner, and radiant energy is reflected by the reflector 22.

The mesh of the cylindrical port screen 38 is relatively fine and the cylindrical side wall provides considerable area so that the flow of the air/fuel mixture from the burner tube into the burner is flowed down, thereby decreasing noise. The folded end 40 of the port screen decreases the porosity of the end and further reduces the flow rate through the end. The port screen diffuses the air/fuel mixture within the spherical burner screen and assists in reducing emissions of unburned hydrocarbons from the burner. The flame does not burn inside of the cylindrical port screen, and the port screen functions like a spark arrestor.

The mesh of the outer hemispherical screen 48 is finer than the mesh of the inner hemispherical screen 47. This forces a higher percentage of the burning air/fuel mixture to exit through the inner hemisphere 47 thereby retaining the mixture within the burner screen longer, reducing emissions, and increasing the temperature of the inner hemispherical screen. Since the inner hemispherical screen is closer to the reflector 22, the radiation efficiency of the heater is improved. The diameter of the burner is sized so that the pressure of the air/fuel mixture within the burner is greater than atmospheric pressure. This not only reduces emissions but makes the burner wind-resistant.

In one specific embodiment the port screen 38 was 40 mesh, the inner hemispherical screen was 30 mesh, and the outer hemispherical screen was 40 mesh. All of the screens were Inconel wire cloth type 600 or 601 with a wire diameter of 0.010 inch. The diameter of the cylindrical port screen 38 was 0.50 inch and the length of the cylindrical port screen was 0.68 inch. The inside radius of the hemispherical screens 47 and 48 was 0.63 inch. This provided a burner with approximately 3500 to 5000 BTU per hour, depending upon the setting of the regulator 29.

Reflector

The reflector 22 includes a curved reflecting wall 60 (FIGS. 7–10) and a pair of flat side walls 61. The outer periphery of the walls is flared rearwardly to provide a smooth curved rim 62. The elongated opening 35 for the burner tube 25 is provided in the rear end of the reflector wall. The center of the opening 35 lies along the center line 63 (FIGS. 9 and 10) of the reflector. A pair of support arms or lever arms 64 are attached to the reflector and extend rearwardly along side the side walls 61 in line with the center line of the reflector.

Figure 5:
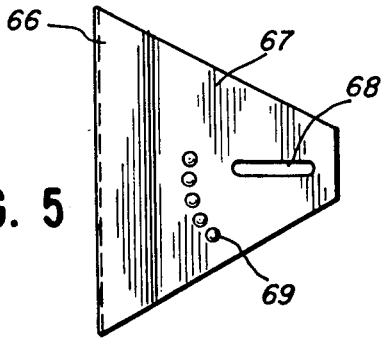
FIG. 5 is a side elevational view of the support bracket for the reflector.
Figure 6:
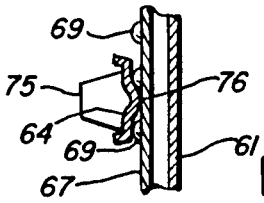
FIG. 6 is an enlarged fragmentary sectional view taken along the line 5—5 of FIG. 3.

A U-shaped support bracket 66 is mounted on the front wall of the base and includes a pair of forwardly extending parallel bracket plates 67. Referring to FIG. 5, each of the bracket plates is provided with an elongated slot 68 which extends parallel to the outer end portion 34 of the burner tube. A plurality of embossments 69 are formed in each bracket plate, and the embossments extend along an arcuate path.

Figure 4:
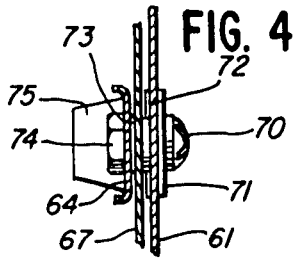
FIG. 4 is an enlarged fragmentary sectional view taken along the line 4—4 of FIG. 3.

Referring to FIG. 4, a bolt or screw 70 extends through a washer 71, a bolt hole in each of the reflector side walls 61, a washer 72, a cylindrical spacer 73, and a bolt hole in one of the lever arms 64. The cylindrical spacer 73 extends through the elongated slot 68 in the bracket plate 67, and the diameter of the spacer is just slightly less than the width of elongated slot 68. A nut 74 is screwed onto the outer end of the screw 70 and clamps the lever arm tightly against the spacer 72 so that the lever arm is fixed with respect to the reflector. The forward end of each lever arm is bent inwardly toward the reflector side wall 61, and the forward end of the lever arm is clamped against the reflector side wall by the screw.

The bolts 70 and spacers 73 support the reflector for pivoting or tilting movement, and the spacers are slidable within the slots 68 in the bracket plates to permit the curved reflecting wall 60 to be moved toward or away from the burner. The outer end of each lever arm 64 extends laterally outwardly, and a knob 75 of insulating plastic is mounted thereon. The reflector can be moved by gripping the knobs.

A rib 76 is formed in the rear portion of each of the lever arms 64 and is engageable with the embossments 69 on the bracket plate as the lever arm pivots about the bolt 70. The embossments provide detents which hold the reflector in various tilted positions.

The curved reflecting wall 60 is in the shape of a parabola and has a focal point designated F.P. in FIGS. 7–10. The focal point can be moved relative to the burner by sliding the bolts 70 along the slots 68 in the bracket plates.

In FIG. 9 the focal point is behind the burner and the radiant energy from the rear half of the burner is dispersed by the reflecting wall 60 as indicated by the arrows. In FIG. 10 the focal point is centered within the rear half of the burner, and radiant energy from the rear half of the burner is focused by the reflector wall 61 and reflected forwardly in a concentrated beam in a direction parallel to the center line of the reflector.

The forward ends of the elongated slots 68 in the bracket plates provide forward stops for the spacers 73 and the reflector. The ends of the slots are advantageously positioned so that the focal point of the reflector is centered within the rear half of the burner when the spacers abut the forward ends of the slot.

Figure 21:
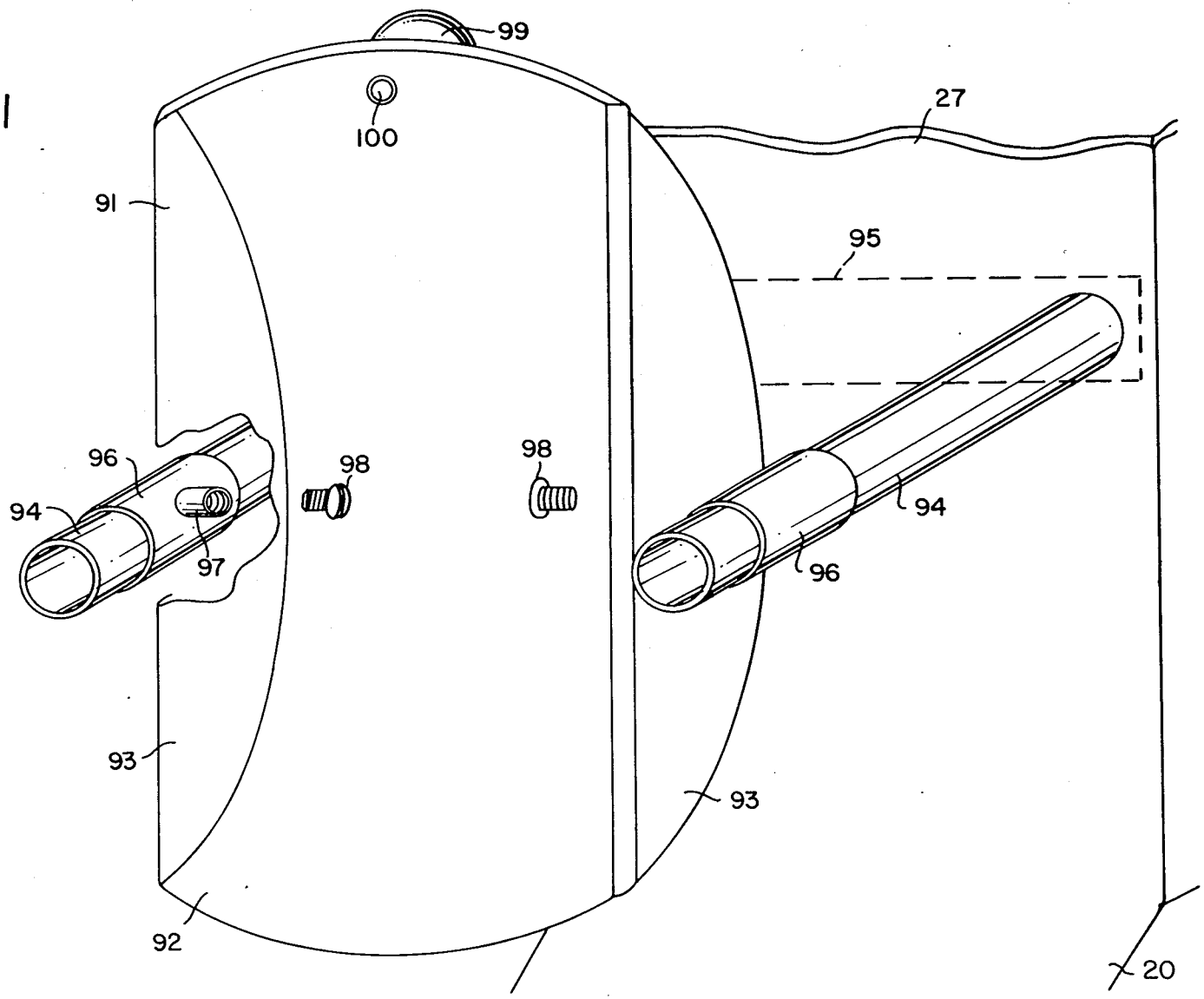
FIG. 21 is a fragmentary perspective view of an alternate embodiment of the reflector.

An alternate embodiment of the reflector is illustrated in FIG. 21. A reflector 91 similar to the reflector 22 includes a curved reflecting wall 92 and a pair of flat side walls 93. The reflector is provided with an opening (not shown) similar to the elongated opening 35 in the reflector 22 for the burner tube 25.

A pair of support tubes 94 extend through openings in the upper portion 27 of the heater 20 and are attached to a support bracket 95 which is secured to the inside of the front wall of the upper portion 27. A tubular slide 96 is pivotally mounted on each of the side walls 93 of the reflector. An internally threaded tubular pivot 97 extends laterally inwardly from each slide 96 through an opening in the side wall of the reflector and is retained against withdrawal from the side wall by a screw 98 which is screwed into the pivot from inside of the reflector.

The slide 96 can slide along the slide supports 94 to adjust the focal point of the reflector relative to the burner head 23. The pivot axis which is aligned with the pivots 97 extends through the focal point of the reflector, and the reflector can be pivoted about this axis to direct the energy as desired.

An adjustment knob 99 is secured to the top of the reflector by a screw 100 to provide an insulated grip for moving the reflector.

Safety Guard

A safety guard 77 is mounted on the reflector to prevent objects from contacting the burner. The guard is formed from a pair of V-shaped wire rods 78 and 79 (FIGS. 1, 2, 19, and 20) which project forwardly from the side walls 61 of the reflector and a generally rectangular wire rod 80 which extends between the V-shaped rods. The rectangular rod 80 includes a pair of side portions 82 and 83 which extend parallel to the side wall 61 of the reflector and a pair of V-shaped end portions 84 and 85. The parallel rods 82 and 83 are welded to the inside of the V-shaped rods 78 and 79, and the apex of each of the V-shaped rods 84 and 85 is spaced slightly inwardly from the apex of the V-shaped rods 78 and 79.

The ends of the V-shaped rods 78 and 79 extend through holes in the side walls 61 of the reflector. The ends 86 (FIG. 2) of the rod 78 are turned upwardly, and the ends 87 of the rod 79 are turned downwardly to hold the guard on the reflector. The ends of the rods 78 and 79 can be flexed inwardly in order to insert them into the holes in the reflector, and the resilient rods will return to their initial positions after insertion in order to hold the guard on the reflector.

A triangular shield 88 (FIGS. 1 and 20) is welded to the lower V-shaped rod 79 to shield radiant energy from the surface which supports the heater.

The reflector and safety guard are lightweight, and most of the weight of the heater is provided by the propane tank. The center of gravity of the heater is therefore well behind the reflector and is substantially in line with the propane tank. If the heater is accidentally tipped over so that the safety guard contacts the supporting surface, the V-shaped safety guard will cause the heater to roll over to one side or the other. The safety guard therefore ensures that the reflector will not direct heat or radiant energy toward the supporting surface.

The dimensions of the base of the heater are such that after the safety guard causes the heater to roll over on its side, the heater will be supported by the sides of the top and bottom base and by the insulating hand knobs 75. The hot reflector will therefore be supported out of contact with the surface.

While in the foregoing specification a detailed description of a specific embodiment was set forth for the purpose of illustration, it will be understood that many of the details herein given may be varied considerably by those skilled in the art without departing from the spirit and scope of the invention.

I claim:

1. A radiant heater combining a base, a reflector mounted on the base, the reflector including a curved reflecting wall having a focal point, a burner tube mounted on the base and extending through an opening in the reflector, a burner head on the end of the burner tube, a pair of spaced-apart elongated mounting members mounted on the base, slide means mounted on each mounting member and being movable along a portion of the length of the mounting member for slidably supporting the reflector, and pivot means mounted on each of the slide means for pivotally supporting the reflector whereby the reflector is pivotably mounted on the base to permit tilting movement of the reflector relative to the burner head and the slide means are movable along the spaced-part elongated mounting members to permit movement of the curved reflecting wall of the reflector and the focal point thereof toward and away from the burner head so that radiant heat energy from the burner can be focused and dispersed by the reflector wall, the reflector including a parabolic rear reflecting wall and a pair of flat sidewalls, said means for pivotally mounting the reflector providing a pivoting axis for the reflector which extends through the sidewalls forwardly of the parabolic rear wall.

2. The heater of claim 1 in which the pivoting axis is generally aligned with the focal point of the parabolic rear wall.

3. The heater of claim 1 in which means are provided on each slide to releasably position the slide and thereby prevent movement along the elongated member.

* * * * *